United States Patent [19]

Speidel

[11] 3,945,881

[45] Mar. 23, 1976

[54] FOURDRINIER STEAM SHOWER

[75] Inventor: Thomas O. P. Speidel, Bedford, Mass.

[73] Assignee: Lodding Engineering Corporation, Auburn, Mass.

[22] Filed: Sept. 11, 1974

[21] Appl. No.: 505,131

[52] U.S. Cl. ..... 162/208; 162/290; 162/375; 34/155

[51] Int. Cl.[2] ..... D21F 5/18

[58] Field of Search ..... 162/208, 290, 207, 375; 34/34, 155

[56] References Cited

UNITED STATES PATENTS

| | | | |
|---|---|---|---|
| 3,089,252 | 5/1963 | Daane et al. | 34/34 X |
| 3,777,781 | 12/1973 | Dove | 162/290 X |
| 3,795,578 | 3/1974 | Dupasquier | 162/290 |

*Primary Examiner*—Arthur D. Kellogg
*Attorney, Agent, or Firm*—Frank A. Steinhilper; Alfred H. Rosen

[57] ABSTRACT

A Fourdrinier steam shower positioned over the wire includes a steam distributor pipe extending across the path of motion of the machine wire and fed with pressurized steam. This steam pipe is connected to support members in the Fourdrinier machine. Positioned around said steam pipe for the width of the machine wire is a steam distributor including legs extending downward and outward from the pipe at an angle so as to define and enclose a steam chamber open at the bottom. Steam enters the steam distributor from jets in the steam pipe and is directed through a tortuous path into the steam chamber. Water collecting in the legs of the steam distributor is discharged through drains located at the bottom of each leg.

6 Claims, 6 Drawing Figures

FOURDRINIER STEAM SHOWER

BACKGROUND OF THE INVENTION

In a Fourdrinier or paper making machine, it is usual to flow a dilute aqueous slurry of fibrous material onto a continuously moving continuous wire. Ordinarily, the fibrous material is cellulose or wood pulp and the slurry may, if desired, contain various paper additives such as sizing or materials to improve strength or other properties. After the slurry is laid down on the wire, the water is drained off, the resulting web of paper is dried and, if desired, further materials or coatings may be placed on the paper.

One of the problems associated with the paper making process is the removal of the relative large quantity of water from the paper fibers. The greatest part of this water is removed by drainage through the Fourdrinier wire. It is usually, thereafter, further removed by passing the wire over a suction box which draws the water through the fiber and wire. Then it is the usual practice to press the paper, similarly to remove additional water, after which the remainder of the water is removed by evaporation. In the earlier stages, the paper fibers which have been freshly laid down are obviously and visibly wet. As this newly formed paper web advances through the machine, it reaches a point known as the "dry line" at which the paper looks dry. At this point, the paper will usually contain several times as much water as fibrous material and it is the removal of this residual quantity of water which is most troublesome.

If a significant improvement can be made in the removal of this water, one or both of two benefits can be achieved. In the one instance, operating with existing equipment whose speed is not limited by other factors, it is possible to increase the speed of the wire and thus increase the speed of the entire paper making process. Ordinarily, a paper machine operates at a speed ranging between extremes of about 50 to about 5,000 feet per minute, but more usually from about 600 feet a minute with a bulky paper to roughly 3,000 feet per minute, depending of the nature of the paper, its thickness or basis weight, the added materials and a number of other factors, but a typical speed is about 1,500 feet per minute. If a significant increase in speed is achieved, the result is that a greater quantity of paper is made on the machine in a given period of time and with a given amount of labor producing a finite cost reduction in an extremely cost conscious industry. Accordingly, the reduction in cost of the finished paper product can be quite significant as a consequence of even a very small increase in the rate of removal of its water.

In other cases, it is possible to achieve very substantial reductions of cost in other forms. For example, if new equipment is being constructed, it can be made considerably shorter if a lesser quantity of water must be removed after the paper has passed through the preliminary steps of water removal and very important capital investment can be saved, again in a highly cost conscious industry.

One of the points of opportunity for increased efficiency or effectiveness of removal of water from newly formed paper is at a point approximately at the dry line, or the point at which it is usual to pass the machine wire over one or more suction boxes to remove that portion of the water which can be drawn from the paper web through the wire and into a drainage mechanism. Water or moisture that remains in the paper beyond this point is usually removed by pressing and by evaporation requiring very significant amounts of heat.

It has previously been known that water can be removed either more completely or more quickly from the paper web at the suction boxes if the temperature of the paper and the water is significantly elevated. The reason for this improvement has not been fully understood but it is believed that it is a consequence of either or both of two factors. If there is substantial increase in the temperature of the water, there is also a very substantial decrease in its viscosity with the result that it flows more quickly away from the paper fibers. For example, raising the temperature of water from about 110°F to about 140°F just about halves its viscosity. It is also true that with a significant increase in temperature, there is a measurable decrease in the surface tension of the water, with the expected consequence that more of the water can be removed at the suction boxes. Whatever the reason, hotter water is removed both more quickly and more nearly completely. The appropriate increase in the temperature has, in the past, been accomplished by heating the moist paper with steam. For this purpose, it is most desirable that the steam be essentially saturated so that the largest quantity of heat can be transferred from the vapor to the paper web by condensation. The use of steam in paper manufacture is a common procedure, and is commonly not well understood. For example, Dupasquier U.S. Pat. No. 2,642,314 uses a steam shower for control of the surface characteristics. A few years later the same Dupasquier, in a later U.S. Pat. No. 2,809,867, used steam in an upward stream from beneath the wire, and found this advantageous. Goyette, U.S. Pat. No. 2,949,239 also uses steam in a paper making machine for an unstated purpose, directed in a converging flow between rolls. Furthermore, steam has been used, and is now used in practice to assist in drying the paper web. The method and apparatus most generally now in use to heat the paper web and the water contained in the web employs a relatively large and heavy steam box placed directly above the paper web at the suction box location. This steam box has a number of slits in its bottom and a number of V-shaped troughs, both running across the direction of motion of the paper. Steam is fed to this box where, hopefully, any condensed moisture falls into the troughs and can be drained off while steam is forced through the slits and down toward the paper. Such a system is illustrated in Dupasquier U.S. Pat. No. 2,838,982.

This commonly used system has a number of drawbacks, some of which are a consequence of mechanical ackwardness and some of which are process related and are likely to bring about machine stoppage or to produce water spotting on the paper from condensed moisture which is not fully separated from the steam.

For example, the slits of the commonly used equipment, which are quite narrow and which are positioned quite close to the paper, can and do become clogged or partially clogged so as to interfere with the flow of steam onto the paper. In addition, the troughs tend to become partly or largely filled with water which is entrapped in the steam and may be spattered onto the paper, producing permanent water spots on the paper web. Some of these difficulties occur primarily when a machine is first started up and, accordingly, the problems are partly alleviated by raising the relatively heavy steam box a number of inches above the paper until the machine is operating at its equilibrium condition. Attempts to remedy these flaws in the prior systems have been made and have failed generally because efforts to make the steam box smaller and lighter have usually resulted in uneven end-to-end performance of the equipment. In addition, the results, while being a substantial improvement over results achieved without such heating of the web, have still produced less removal of water than is desired, and a great deal of expense is involved in subsequent heat-drying of the web. The horns of the dilemma have appeared to be the incompatible characteristics that reducing the flow of steam reduces the amount of heat which can be transferred to the paper and thus limits the amount of water that can be drawn from the paper at the suction boxes, while on the other hand increasing the flow of steam seems inevitably to lead to water spotting of the paper.

GENERAL NATURE OF THE INVENTION

The present invention includes an improved device for the distribution of saturated steam to the paper as early as possible at the dry line. Saturated steam is supplied to a steam distributor extending essentially across the path of motion of the machine wire at the dry line and fed with steam at a pressure which will produce what is known as "choked flow." As a consequence of maintaining the conditions of choked flow, the end-to-end distribution of steam is extremely uniform, and a substantial increase in steam pressure produces only relatively little increase in rate of flow. The steam is then directed in a confined path including a significant whirling motion which effectively throws condensed moisture out of the steam vapor into a collecting drain. The result is much as if the steam were centrifuged. After passing through a confined and reversing path, the steam is then distributed in an expanding path across the entire area of the paper web where it is drawn through the paper at a point beyond the dry line so that the steam passes through the paper and transfers the maximum quantity of heat to the paper by the condensation of a quantity of the steam onto or into the paper. Instead of making contact only with the upper surface of the paper, the steam makes contact throughout the volume of the paper and is capable of raising the temperature of the paper and its water contained therein by an amount from around 20°F or 30°F to as much as 80°F to 100°F if desired.

According to a presently preferred embodiment of the invention, the apparatus for achieving this result comprises the source of steam and a first distribution device which may be simply a steam pipe positioned above the machine wire and extending thereacross. This pipe has at least one series of holes or jet members positioned to direct steam at an angle into a confined zone or chamber, also extending across the width of the machine wire. Optionally, a plurality of such rows of jets may be used, each directing jets of steam into a confined zone. The confined zone or zones may desirably be shaped triangularly like the legs of a capital letter A, whereby in addition to confining the flow of steam and swirling it to throw out condensed moisture, they also form a mechanically strong and light structure. The are, further, so shaped that a reversing or whirling motion of steam is caused within the confined zone.

The condition of choked flow which is desirable in order to achieve uniformity of steam flow across the entire width of the web is generally achieved with a steam pressure outside the pipe which ordinarily is approximately atmospheric. The mathematics of fluid flow through a jet shows that when the pressure at one end of a jet member approaches double the pressure at the other end, the jet chokes up and accordingly, it is generally preferred to maintain the pressure within the pipe at a little bit more than 15 pounds gauge pressure and a suitable pressure has been found to be approximately 20 pounds per square inch gauge, which is sufficient to insure end-to-end uniformity while at the same time being sufficiently low so that upon emerging from the combined paths of travel and being directed onto the paper web, the steam is essentially saturated to achieve maximum heat transfer from steam to paper.

When the present invention is employed in connection with the production of a paper such as newsprint which ordinarily has a basis weight of about 30 pounds per 3,000 square feet, it has been found that the moisture content of the paper measured after it leaves pressing rolls can be reduced from about 1.1 times the weight of the paper to about 1.0 times the weight of the paper. This is about a 10% reduction in the amount of water, and can be roughly translated into a 10% increase in machine speed in favorable conditions. Where machine speed is not limited by other factors unrelated to water removal, an increase in machine speed of up to 10% can be realized, and generally it is to be expected that an increase of 5 to 10% will be quite usual. This is a significant improvement in paper making operations.

The general nature of the invention having been set forth, the invention is now further illustrated in the drawings in which.

DETAILED DESCRIPTION OF THE INVENTION

Figure 1:
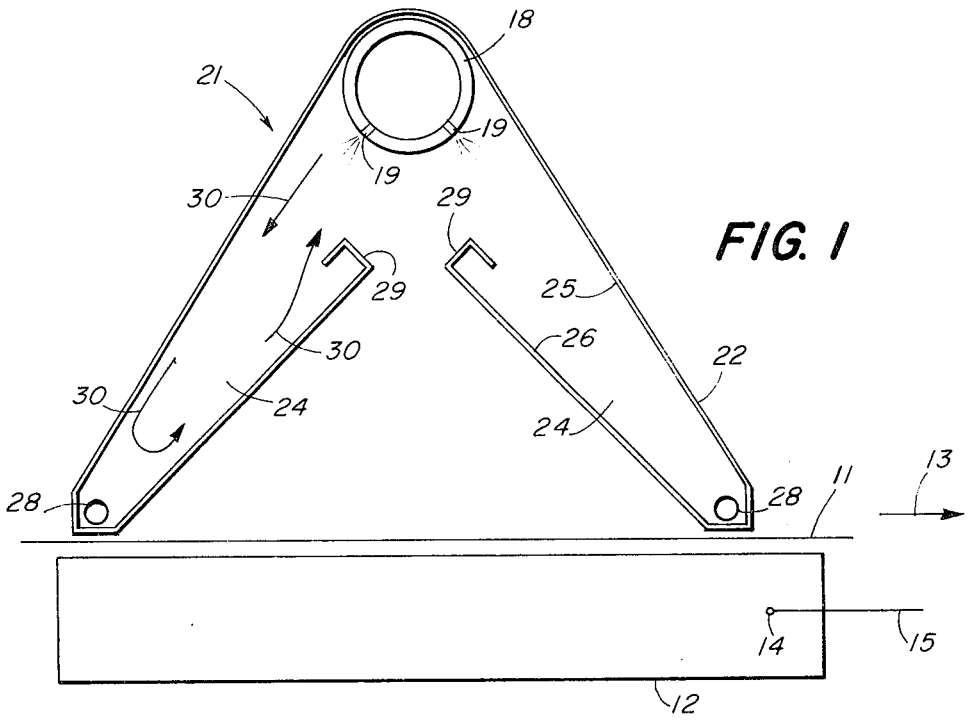
FIG. 1 is a side view in section of apparatus according to one embodiment of the invention.

In FIG. 1 is shown apparatus, according to one embodiment of the invention, in which a steam distributor generally designated 10 is positioned over a Fourdrinier wire 11 at a location substantially above a suction box 12. The wire 11 is normally moved in the direction indicated by arrow 13. Optionally within the suction in box 12 may be a thermostat 14 or other temperature measuring device adapted to send a control signal through a wire 15, the lead portion of which is illustrated in the figure. The Fourdrinier wire 11 and suction box are conventional components of paper making machines and are adapted to work in their conventional manners.

Figure 3:
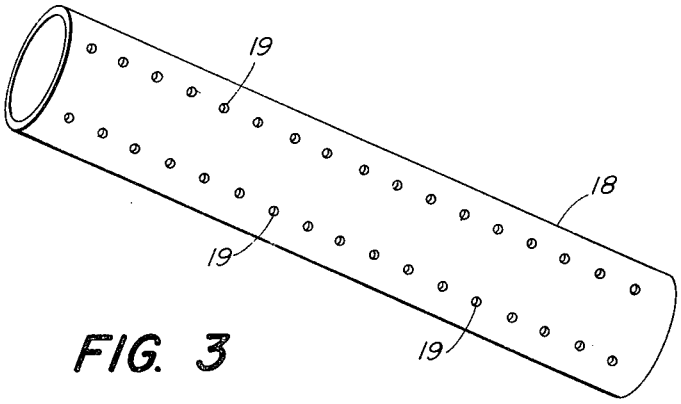
FIG. 3 is a perspective view of a portion of the apparatus of FIG. 1.

The steam distributor 10 includes, near its upper end, a steam conveying means or pipe 18 (also illustrated in FIG. 3) which has a series of jet nozzles 19. This steam pipe is connected to support members or frame work in the Fourdrinier machine (not shown) and can supply all or a major part of the mechanical support for the entire steam distributor 10. Positioned around pipe 18 is a hood 21 which is positioned above or may rest on pipe 18 and including, on each side, legs 22. These legs 22 extend downwardly and outwardly from pipe 18 at a suitable angle so that they cover a moderate length of the machine wire 11 and define an outwardly and downwardly diverging steam chamber 20. In actual practice, a paper making machine ordinarily has a wire 11 which may be as wide as about 400 inches, but generally about 15 or 20 feet. A wire as narrow as 3 feet is considered relatively narrow. Accordingly, the structure of the steam distributor 10 is a relatively massive structure extending entirely across the wire 11 and the legs 22 or steam chamber 20 generally cover several feet of the length of wire 11. This chamber 20 is essentially completely open over its entire bottom. Similarly, pipe 18 is a relative large and extremely sturdy member. If, for example, as may be the case, pipe 18 is a 6 inch steam pipe, it can support, and will support, a much more massive structure than the hood 21.

The lower end of each leg 22 includes a steam control compartment 24 defined by an outer wall 25 and an inner wall 26, usually in the form of a single sheet of metal bent through a 180° curve at its base. At one or both ends of each compartment 24 is a drain 28 adapted to drain off any water which may be collected in compartment 24 from condensation of steam therein or from collection of earlier steam condensation. At the upper end of each compartment 24 at the end of inner wall 26 is a U-shaped baffle 29. The entire assembly of the steam apparatus is mounted as close to wire 11 as is practicable and generally within one or several inches of the wire.

In the apparatus illustrated in FIG. 1 which has two legs 22 defining and enclosing an outwardly and downwardly diverging steam chamber 20, the pipe 18 has two rows of steam jets 19, each aimed away from the downwardly vertical direction and into the compartments 24, generally being aimed to direct steam in a laminar direction along the outer wall 25 of compartment 24. According to the flow of steam within compartments 24 is approximately indicated by arrows 30.

Figure 2:
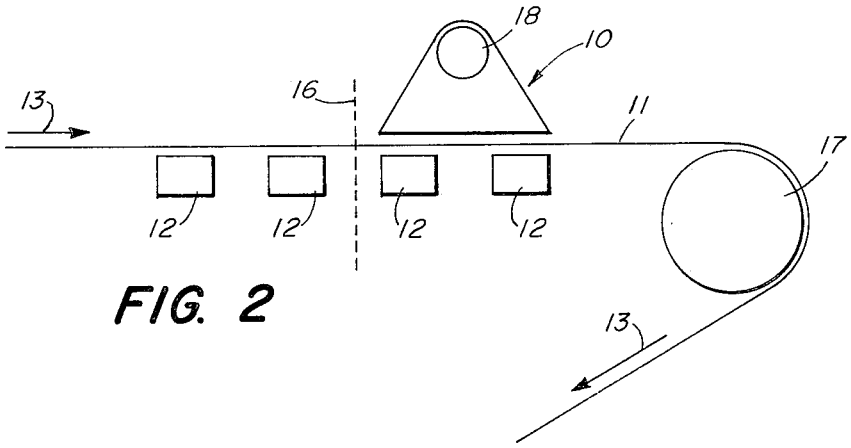
FIG. 2 is a diagrammatic view of paper making apparatus including apparatus according to one embodiment of the invention.

In FIG. 2 is shown, in outline, a portion of typical paper making apparatus which may include a steam distributor 10 such as the steam distributor illustrated in FIG. 1. In this portion of the apparatus is illustrated the Fourdrinier wire 11 traveling in the direction indicated by arrow 13 around a couch roll 17. A plurality of suction boxes 12 are positioned beneath the wire 11 prior to its reaching the couch roll 17. The dry line 16 or point at which the paper looks dry is indicated to be between a pair of these suction rolls. Positioned beyond the dry line 16 in the direction of motion of wire 11, is the steam distributor 10 which may be associated with one or more suction boxes 12.

The apparatus and method of the present invention will bring about the removal of a substantial amount of water over and above that which can be removed by ordinary methods and will remove this water without the danger of spotting the paper. Moreover, the removal of water is essentially uniform from one side of the machine to the other. In order to achieve these results, however, there are certain things which should be kept in mind in the construction and operation of the apparatus.

In order to have a side-to-side uniformity of water removal, it is appropriate to have end-to-end uniformity of the flow of steam through the rows of jets 19 in pipe 18. This is accomplished in the preferred embodiment of the invention by having each of jets 19 approximately the same in flow capacity and by maintaining steam pressure within the pipe 18 at approximately twice the pressure of steam or other vapor outside the pipe and within the steam distribution hood 21. It is known that a condition known as "choked flow" occurs when a gas is flowing through a jet opening with the pressure forcing the gas through the opening about equal to the total pressure into which the gas is flowing, or in other words, with the pressure behind the jet about double the pressure in front of the jet. When the pressure behind the jet or, in this case, within pipe 18 is less than about double the pressure within the hood 21, there is a substantial difference in the rate of flow of the steam through the jets as the pressure changes. On the other hand, when the pressure within the pipe 18 is approximately double the pressure in hood 21, the steam flows through the jets at essentially sonic velocity and there is very little difference in rate of flow with a substantial increase or decrease in the driving pressure. Since hood 21 is open to the atmosphere adjacent to the wire 11, it is apparent that the pressure within the hood will ordinarily be approximately atmospheric pressure, and thus a pressure of at least about 15 pounds per square inch gauge within pipe 18 will maintain this condition of choked flow. To obviate concern about the fluctuation in steam pressure, it has been found commercially practicable to operate at about 20 p.s.i. gauge pressure within pipe 18. This pressure is sufficiently high so that there is essentially no likelihood of pressure fluctuation sufficient to cause a significant change in the rate of flow of steam through jets 19.

One of the consequences of maintaining the condition of choked flow is that the steam flow through jets 19 is noisy. The larger the jets the greater the noise; the smaller the jets the more difficult and, accordingly, more expensive it is to maintain substantial uniformity in jet size from one end to the other of pipe 18. Jet sizes of approximately ¼ inch diameter may be somewhat noisier but generally is of an acceptable level compared with other sound levels in ordinary paper mill operations. Jets of approximately ⅛ inch diameter have been found to be essentially inaudible in operating conditions in a paper mill. Smaller jets have been employed and, in fact, jets of 1/16 inch diameter have been found to be nearly inaudible in operating conditions other than paper mills where other structures cause an apparent amplification of the sonic noise. In certain conditions, larger jets such as ½ inch in diameter and perhaps up to 1 inch in diameter have been found to be acceptably quiet in actual working conditions. Needless to say, the smaller the jets the larger the number which must be used to obtain in optimum flow of steam through the system. Using the system described herein with sizes appropriate for present day paper making operations, it has been found that two rows of jets of about ⅛ inch diameter with the jets being approximately five to ten inches apart produces a good rate of steam flow with a fully acceptable noise level.

It is of great importance in paper making operations to minimize the presence of droplets of condensed water in the steam atmosphere within hood 21. Such condensed droplets of water, if they are excessively large, will fall or be drawn onto paper or wire 11 and may cause a permanent water spot on the paper. Where high quality paper is being produced, such water spots are unacceptable. In order to avoid this danger, the steam from jets 19 is not directed immediately to the wire 11 but instead is directed through a confined tortuous path which causes condensed water droplets to be removed from the paper prior to entering the diverging steam chamber 20. As seen in FIG. 1, the jets 19 direct the steam along outer wall 25 of legs 22 in such manner that the flow of steam is sharply reversed near the bottom of each leg. The rate of flow of steam in this confined area is relatively high inasmuch as the steam emerging from jets 19 was originally at essentially sonic speed or roughly 1,100 feet per second. Accordingly, a centrifuge effect is realized at the bottom of chambers 24 and condensed droplets are deposited at the bottom of or against the walls of chambers 24. As the apparatus continues to operate, these condensed droplets gather in the bottom of chambers 24 and flow out at the ends of hood 21 through drains 28. In the presently preferred embodiment of the invention, these chambers 24 are relatively deep, and are sufficiently deep so that it makes very little difference whether several inches of water may collect in the bottoms of these chambers for draining out through drains 28. Even when the collection of water is relatively deep it is not again picked up by the flowing steam and thus is not conveyed out of chambers 24 into the diverging volume of hood 21. In addition, at the upper ends of inner walls 26 of these chambers 24, a baffle 29 serves further to collect any stray condensed water particles which may still be present in the steam flow.

The flow of steam within hood 21 after emergence of the steam from chambers 24 is generally in a downwardly and outwardly diverging direction to maintain an essentially uniform volume of essentially saturated steam within the volume of the hood. This steam flows downwardly toward screen 11 or toward a paper web moving along screen 11 and is positioned approximately at or beyond the dry line of the paper machine. Generally the hood 21 covers a distance of no more than about 3 to 6 feet along the line of motion of wire 11 of the Fourdrinier machine or over a suction roll. In the practical and commercial art, a paper machine whose wire travels at a rate of 600 feet per minute, is generally considered relatively slow while machines may operate at speeds as high as 3,000 feet per minute or even substantially higher. Accordingly, the exposure of the paper to the steam vapor within hood 21 can be expected to range between approximately ¼ of a second to as little as perhaps 1/20 of a second or even less. Obviously the amount of heat which can be transferred from a gas merely flowing against the surface of the paper in such a short time can have a minimal affect on the temperature within the volume of the paper web. Hood 21, accordingly, is positioned at the location of a suction box 12 and approximately at the dry line so that saturated steam does not merely brush the surface of the paper web but is actually drawn through the web so that the steam contacts the internal volume of the paper web as well as its upper surface. In addition, the steam within hood 21 is essentially saturated or, in other words, is at essentially 212°F at atmospheric pressure. As the saturated steam passes through the cooler paper web, steam condenses and releases its latent heat of condensation. Many times as much heat is transferred from the steam to the web by such condensation as compared with the amount of heat transferrable from super heated steam which is heated to too high a temperature for condensation.

In normal operating conditions, it has been found that the temperature of a paper web will be raised upwards of about 20°F and generally about 30° or 40°F depending upon the thickness of paper being formed and the speed of the wire 11. Using newsprint as a typical illustration, it is found that the operation of the present invention with a hood having a spread of about 3 or 4 feet will raise the web temperature from about 110°F to about 140°F. This extent of change in temperature brings about two complementary results. In the first place, white water or water with the normal dissolved and suspended materials encountered in paper making operations, undergoes a reduction of its viscosity in the order of about 50% when the temperature of the water is increased from about 110°F to about 140°F. This means that water can be withdrawn from the paper web at a much higher rate. In addition, when this same water is raised by this same temperature differential there is a less dramatic but significant decrease in its surface tension. When the surface tension is thus decreased, the water clings less tenaciously to the paper fiber with the result that water can be removed not only more quickly, but more nearly completely. The combination of these two complementary affects reduces dramatically the quantity of water which must subsequently be removed from the paper by other methods such as, for example, heat evaporation.

The apparatus and method of the present invention achieves the desired result in a manner which is much more effective, much more practicable, much more reliable and much safer than the methods and apparatus previously employed. The typical system most commonly employed at the present time is a modification of the system shown in Dupasquier U.S. Pat. No. 2,838,982 and particularly illustrated in FIG. 3 in that patent. Differences between the present invention and the systems presently in use, including that of Dupasquier and others, result in very significant advantages. Among these advantages, the present invention provides for a deep receptacle for condensed water vapor such that there is essentially no danger whatsoever that condensed water will be carried by the flow of steam into the downwardly diverging steam flow within hood 21. In addition, the flow of steam through the combined and reversing pass of flow removes essentially all of the particles of condensed water vapor from the live steam and removes these particles at a location where they are not susceptible to being picked up by the flowing steam. According to the present invention, the steam jets 19 are at a position far removed from the surface of the paper and are so located that any condensation or impurities which may form at or around the exits of the jets will be directed into chambers 24 where this condensation will be collected and removed from the flowing steam. In addition, this distant relationship between the steam jets and the paper has, as a consequence, a near impossibility for mechanical contamination or clogging of the jets by action of any paper solids in normal operation. The only thing which comes close to the jets is the steam itself. A very significant advantage of the present invention as compared with existing practices is the major difference in safety. Ordinarily, safety valves are employed to prevent a steam box from building up excessive pressure and exploding. According to the present invention, the hood and the volume within the hood 21 of this invention operates essentially at atmospheric pressure and the space between the hood and the paper is always maintained free and clear. Steam pressure exists only within pipe 18 which is a pipe or steam conveying member adapted to carry steam at pressures far higher than those employed in this invention. It is ordinarily designed to operate at pressures up to several hundred pounds per square inch and in this invention is used with a steam pressure in the range of only about 20 pounds per square inch.

The disadvantages of presently employed systems are of greatest concern when the Fourdrinier machine is stopped and restarted. During stoppage or at start-up, there is increased danger of contamination from paper solids or other sources. During such periods of stoppage with the present invention, there are no active or critical parts of components of the apparatus which can be contaminated, blocked or clogged. In ordinary paper mill operations, these dangers and problems are so well understood that it is usual to provide that steam application apparatus be substantially removed from the machine either by raising it a significant distance above the machine wire or occasionally actually removing it completely. Such apparatus, after it has been raised, must be operated for a period of time to achieve a steady operating condition in order to avoid excessive condensation of steam when the paper machine is first restarted.

These various disadvantages of the prior art are avoided with the present invention and a number of advantages are achieved in a very simple straight forward and economical manner.

Figure 4:
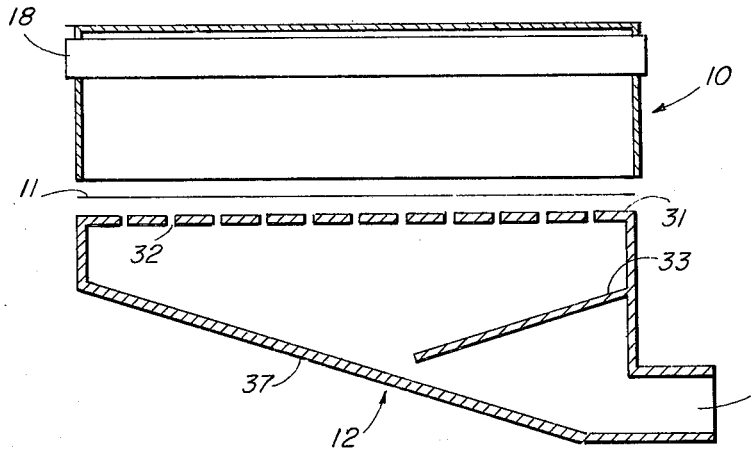
FIG. 4 is a diagrammatic end view, partially in section, illustrating a portion of apparatus according to another embodiment of the invention including a modified suction box associated therewith.
Figure 5:
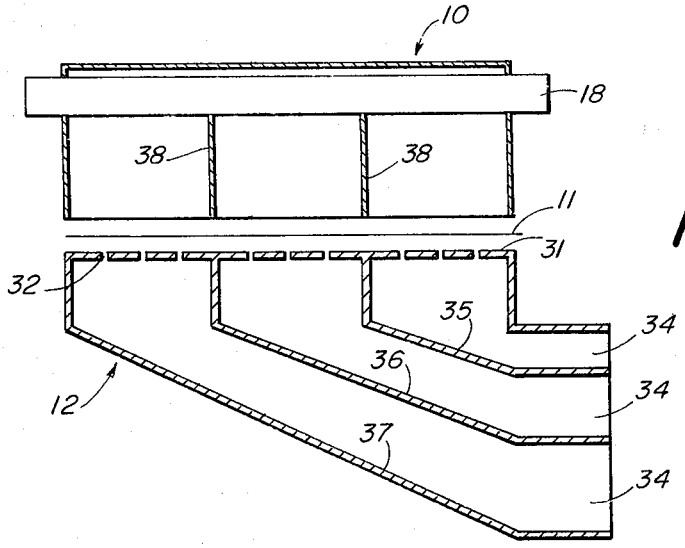
FIG. 5 is a diagrammatic end view of a still further embodiment of the invention.
Figure 6:
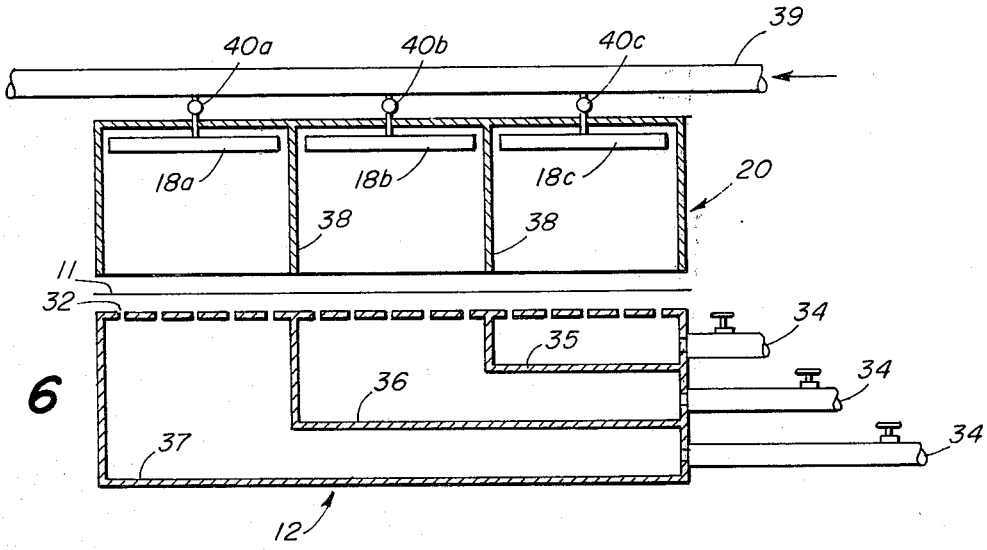
FIG. 6 is a diagrammatic end view of still another embodiment of the invention.

In FIGS. 4, 5 and 6 are shown modified apparatus and, in particular, various modified suction box and steam distributor apparatus which can be combined to achieve greater flexibility or greater uniformity in the drying of paper in accordance with the present invention.

FIG. 4 shows a steam distributor 10 of the type illustrated in FIG. 1 positioned above the machine wire 11. Beneath the wire 11 is a suction box generally designated 12 including an upper or suction wall or suction plate 31 having a plurality of holes 32 permitting the flow of steam or air and accompanying water through a wire 11, through the suction plate 31 and into the suction box 12. The suction box 12 has a bottom wall 37 inclined downwardly to drain water to a suction outlet 34 at one side of the suction box 12. Mounted within suction box 12 is a baffle 33 inclined downwardly toward bottom wall 37 at approximately the same angle as the angle of inclination of bottom wall 37. The end of baffle 33 is spaced from wall 37 approximately at the middle of the suction box 12 and defines an exit passage for steam air and water essentially at the middle of the suction box 12 and essentially below the middle of wire 11. This structure provides relatively uniform air flow from side to side through wire 11 and its supported paper web, with perhaps a moderately higher rate of flow near the center of the wire 11 and web essentially above the exit gap between baffle 33 and bottom wall 37. This provides improved side-to-side uniformity of steam flow through the paper web. In addition, in paper operations, it is not unusual for the edges of the paper to dry more rapidly or more thoroughly than the center portions of the paper and this slightly increased flow of steam through the center portions at least partly corrects normal non-uniformity.

In FIG. 5 is shown another modification of the steam distributor 10 and the suction box 12 wherein both the steam distributor 10 and the suction box 12 are compartmentalized. Within the steam distributor 10 are a plurality of baffles 38 dividing the steam chamber into two or more zones across the width of the wire 11. Beneath the wire 11 is a suction box 12 having upper plate 31 having holes 32 therein, as in FIG. 4, to permit suction of steam through wire 11. The suction box also is compartmentalized, having several baffles therein dividing the suction box into compartments which may approximately correspond in width and location to the compartments in the steam distributor 10. Illustrated is an upperwall or baffle 35 defining a compartment leading to suction outlet 34. Beneath baffle or wall 35 is a second baffle or wall 36 defining a second compartment leading from essentially the middle portion of wire 11 to outlet 34. Baffle 36 also defines, in conjunction with bottom wall 37, a third compartment leading from the far edge of wire to outlet 34. The exit portion or narrowest portion of each of these compartments joined to outlet 34 is of predetermined size or capacity. As illustrated, the upper baffle 35, which defines a path of flow whose length is shorter, is positioned most closely to a wall of suction box 12 thereby producing a shorter but more restricted path of flow. The second baffle 36 is positioned somewhat further from first baffle 35 to define a path of flow somewhat less restricted but of medium length. Likewise, baffle 36 is positioned still further from bottom wall 37, defining a flow path which is both longest and least restricted. The difference between the pressures causing the flow through these compartments is balanced against the length of the flow path so that the flow is essentially uniform in each of the compartments. If desired, the central compartment or, in the event that there are numerous compartments, the more centralized of such compartments may be proportionately slightly larger to encourage a somewhat greater rate of flow of steam through wire 11 near the center of the wire.

In FIG. 6 is illustrated a compartmentalized system having positive control rather than passive control but generally otherwise corresponding to the compartmentalized system of FIG. 5. As shown in FIG. 6, within the steam chamber 20, are a plurality of baffles 38 separating this chamber into a plurality of compartments. Within each such compartment is a pipe 18*a*, 18*b* or 18*c* connected to a main steam line 39. Each pipe 18*a*, 18*b* and 18*c* has a series of jets as illustrated in FIG. 1. Each compartment is shaped in much the same manner as the steam distributor 10 of FIG. 1 and is adapted to cause steam to flow through a confined path as in the case of FIG. 1. Leading from main steam line 39 to each pipe 18 is a connecting pipe with a valve 40*a*, 40*b* or 40*c* usuable and adapted to control the rate of flow of steam into its associated pipe 18*a*, 18*b* or 18*c*. When the apparatus is operated according to the condition of choked flow, an increase or decrease in pressure within pipe 18 produces a small variation in flow through the jets. By control of valves 40*a*, 40*b* and 40*c*, however, a small difference in rate of flow can be achieved and this small difference can, if desired, be adjusted to produce a slightly greater or slightly lesser rate of steam flow in one or several compartments. This rate can be adjusted to produce side-to-side uniformity, or if desired, selected side-to-side non-uniformity of drying of paper on web 11.

Positioned below wire 11 is suction box generally designated 12 having three compartments defined by walls 35, 36 and bottom wall 37 leading to outlet pipes 34. At each outlet pipe may optionally be a valve 41*a*, 41*b* or 41*c* to control the suction flow in a manner to correspond with the steam flow through corresponding steam valve 40*a*, 40*b* or 40*c*.

It is apparent that numerous further modifications may be made in the present apparatus or in its manner of operation without sacrificing significant advantages of the invention. For example, in the drawings there is illustrated a generally A-shaped hood 21 having two legs and both of which is a steam confining chamber 24 and means for removing condensed moisture therein. If desired, a greater flow of steam can be employed in one of these legs defining the steam chamber and the other leg may be merely a wall enclosing the volume of saturated steam presented to the paper web. If a greater flow of steam is required, there may be additional collecting chambers operating according to the same principal so three or more rows of jets may be employed to provide an additional quantity of steam if so desired. If greater drying of the paper is desired, a greater length of path along the machine wire 11 may be coverec by hood 21. Further, if desired, the paper making process may be modified by including vaporized paper additives in the steam flow and, if the expense can be tolerated, heating vapors other than steam may be employed.

I claim:

1. Apparatus for heating a paper web on a Fourdrinier wire to increase removal of water therefrom comprising a steam chamber positioned above the wire, substantially across the entire width of said wire at least partly beyond the dry line and open across the bottom thereof to ambient atmospheric pressure and essentially completely open to said wire, means beneath said wire positioned to draw steam from said steam chamber through the wire and through a web on said wire, means to feed essentially saturated steam into said chamber, said means including a plurality of steam jets located across said steam chamber, means to supply steam under pressure to said jets to provide a directed flow of steam through said jets, said jets being directed to project steam into a downwardly confined path of travel substantially free from abrupt reversal including at least an upward reversal of direction, whereby condensed steam droplets are adapted to be thrown out of said steam, and thence into said steam chamber, means at the bottom of said confined path of travel at the point of upward reversal to collect condensed steam and to drain water therefrom, a discharge opening into said steam chamber of a size to prevent abrupt expansion of said steam, whereby a volume of dry, essentially saturated steam is drawn through said web and wire to heat said paper by release of latent heat of condensation of said steam.

2. The apparatus of claim 1, wherein said means to supply steam to said jets comprises means to supply steam at a pressure to cause choked flow through said jets.

3. The apparatus of claim 1, wherein steam chamber and said means for drawing steam through said web and wire are divided into a plurality of compartments across said wire adapted to cause different steam flow through said web and wire at different positions across said web and wire.

4. The apparatus of claim 1 wherein means are provided to draw steam from underneath said wire and paper web at a location beneath approximately the center of the moving wire.

5. A method for increasing removal of water from a paper web on a Fourdrinier machine comprising:

directing jets of essentially saturated steam in a downwardly confined path substantially free from abrupt reversal including at least an upward reversal of direction of motion, collecting and removing condensed steam at the bottom of said confined path of motion at the point of upward reversal to provide essentially dry, essentially saturated steam, thereafter directing said saturated steam at atmospheric pressure and substantially free from expansion above said web at a location at least partly beyond the dry line of said paper web, and drawing said steam through said paper web to condense at least a portion of said steam within the volume of the paper web, thereby releasing latent heat of condensation within said web.

6. The methods of claim 5, wherein said condensed steam is collected and removed at a location guarded from contact between said steam and said paper web and guarded from direct flow of said steam onto said paper web.

* * * * *